US006489074B1

(12) United States Patent
Takehara et al.

(10) Patent No.: US 6,489,074 B1
(45) **Date of Patent: *Dec. 3, 2002**

(54) TONER RESIN COMPOSITION AND TONER

(75) Inventors: Hiroaki Takehara, Shiga (JP); Takashi Shinjo, Shiga (JP)

(73) Assignee: Sekisui Chemical Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/719,165

(22) PCT Filed: Mar. 15, 1998

(86) PCT No.: PCT/JP99/01278

§ 371 (c)(1),
(2), (4) Date: Dec. 13, 2000

(87) PCT Pub. No.: WO00/02094

PCT Pub. Date: Jan. 13, 2000

(30) Foreign Application Priority Data

Jul. 1, 1998 (JP) ..... 10-186248

(51) Int. Cl.[7] ..... G03G 9/08; G03G 9/087

(52) U.S. Cl. ..... 430/108.4; 430/108.1; 430/109.3; 430/108.8

(58) Field of Search ..... 430/108.1, 108.8, 430/108.4, 109.3; 524/487

(56) References Cited

U.S. PATENT DOCUMENTS

| | | | | | |
|---|---|---|---|---|---|
| 5,486,445 | A | * | 1/1996 | Van Dusen et al. | 430/109.3 |
| 5,716,746 | A | * | 2/1998 | Mikuriya et al. | 430/109.3 |
| 5,736,288 | A | * | 4/1998 | Kasuya et al. | 430/109.3 |
| 5,780,197 | A | * | 7/1998 | Kubota et al. | 430/108.8 |
| 6,106,988 | A | * | 8/2000 | Furukawa et al. | 430/109.3 |
| 6,120,961 | A | * | 9/2000 | Tanikawa et al. | 430/108.8 |
| 6,190,816 | B1 | * | 2/2001 | Takehara et al. | 430/109.3 |

FOREIGN PATENT DOCUMENTS

| | | | | | |
|---|---|---|---|---|---|
| JP | 07271084 | A | * | 10/1995 | 430/108.8 |

* cited by examiner

*Primary Examiner*—Christopher Rodee
(74) *Attorney, Agent, or Firm*—Townsend & Banta

(57) ABSTRACT

A toner resin composition characterized as containing a vinyl copolymer prepared principally from a styrene monomer and a (meth)acrylic ester monomer and showing peaks at least in the molecular weight range of 5,000–20,000 and in the molecular weight range of not below 500,000 when its molecular weight distribution is determined by gel permeation chromatography, 2–10% by weight of Fischer-Tropsch wax, and 0.5–5% by weight of styrenic block copolymer; and a toner incorporating the toner resin composition.

4 Claims, No Drawings

TONER RESIN COMPOSITION AND TONER

TECHNICAL FIELD

This invention relates to a toner resin composition and a toner for use in the electrophotography and the like, and more particularly to a toner resin composition for use in a dry electrostatic image development process and a toner made therefrom.

BACKGROUND ART

In the field of electrophotography and the like, a dry development process has been widely employed for developing electrostatic images. In this dry development process, triboelectrically chargeable toners and magnetic toners are utilized. The former is prepared by mixing fine particles containing toner resin particles serving as a binder and a coloring material, such as carbon black or the like, with carrier particles such as iron powder or glass beads. The latter is prepared by incorporating a coloring material, such as carbon black or the like, and a magnetic powder, such as magnetite or the like, in toner resins.

A so-called, hot press roll fixation process has come into widespread use in obtaining copies. According to this process, development is generally accomplished by allowing triboelectrically chargeable or magnetic toners to adhere electrically to electrostatic latent images formed on a photoreceptor. The resulting toner images are transferred onto a sheet, such as a paper, and then fixed thereon by toner-releasable hot press rolls.

For future high-speed operation or size reduction of copiers utilizing the hot press roll fixation process, a need has arisen for a toner which can be fixed at a lower temperature. From a point of low temperature fixability, the use of lower molecular-weight toner resins is effective in lowering a fixing temperature to some degree. However, the results have been limited and still insufficient.

Specifically, the toner incorporating a low-molecular-weight toner resin presents the following problems: it tends to accompany a phenomenon (offset) whereby a part of the toner that has failed to form images during fixation is transferred onto hot press roll surfaces and retransferred therefrom onto a coming paper or sheet to result in blurring images; its incorporation of lower molecular weight resins not only reduces the fixing strength of such a toner onto a sheet as of paper, but also increases a tendency for the formed images to be destructed, for example, when rubbed.

In order to solve such problems, Japanese Patent Laying-Open No. Hei 4-226473 has proposed the use of a specific resin composition to provide a toner which exhibits excellent fixability, offset resistance and image quality. The resin composition is prepared by thermally desolvating a resin solution containing a styrene resin such as styrene-(meth) acrylate copolymer, a low-molecular weight wax such as low-molecular weight polypropylene, and a styrenic block copolymer such as styrene-butadiene-styrene block copolymer.

The toner incorporating the resin composition as proposed by the above-identified reference shows improved low-temperature fixability, offset resistance and fixing strength. However, such toner performances are desired to be further increased to sufficiently higher levels that meet future demands of high-speed operation or size reduction.

DISCLOSURE OF THE INVENTION

The present invention provides a toner resin composition which, when incorporated in a toner, imparts thereto improved low-temperature fixability, offset resistance, storage stability and fixing strength with respect to a sheet as of paper. The present invention also provides a toner incorporating the toner resin composition.

In accordance with a broad aspect of this invention, a toner resin composition is provided which is characterized in that the composition contains a vinyl copolymer prepared principally from a styrene monomer and a (meth)acrylic ester monomer, 2–10% by weight of Fischer-Tropsch wax and 0.5–5% by weight of styrenic block copolymer, and that the vinyl copolymer, when its molecular weight distribution is determined by gel permeation chromatography, shows maximum peaks at least in the molecular weight range of 5,000–20,000 and in the molecular weight range of not below 500,000.

In accordance with another broad aspect of this invention, a toner is provided which is characterized in that the toner contains a coloring material and a toner resin composition comprised of a vinyl copolymer prepared principally from a styrene monomer and a (meth)acrylic ester monomer, 2–10% by weight of Fischer-Tropsch wax and 0.5–5% by weight of styrenic block copolymer, and that the vinyl copolymer, when its molecular weight distribution is determined by gel permeation chromatography, shows maximum peaks at least in the molecular weight range of 5,000–20,000 and in the molecular weight range of not below 500,000.

In the present invention, a primary contributor of good low-temperature fixability and offset resistance is the vinyl copolymer prepared principally from a styrene monomer and a (meth)acrylic ester monomer and having maximum peaks at least in the molecular weight range of 5,000–20,000 and in the molecular weight range of not below 500,000.

The Fischer-Tropsch wax, when included in the amount of 2–10% by weight, plays a principal roll of preventing a toner from depositing on hot press roll surfaces and thereby preventing the occurrence of offset at a lower temperature range. Further incorporation of the styrenic block copolymer in the amount of 0.5–5% by weight plays a principal roll of increasing a melt viscosity, leading to the improved offset resistance and fixing strength. While a reason is not clear, the presence of such a styrenic block copolymer also renders the Fischer-Tropsch wax more dispersible than conventional low-molecular weight waxes, such as low-molecular weight polypropylene, thereby enabling its uniform dispersion.

From viewpoints of low-temperature fixability and offset resistance, the present invention utilizes the vinyl copolymer prepared principally from a styrene monomer and a (meth) acrylic ester monomer and showing maximum peaks at least in the molecular weight range of 5,000–20,000 and in the molecular weight range of not below 500,000 when its molecular weight distribution is determined by gel permeation chromatography (GPC).

Examples of styrene monomers used to constitute the above-specified vinyl copolymer include styrene, o-methylstyrene, m-methylstyrene, p-methylstyrene, α-methylstyrene, p-ethylstyrene, 2,4-dimethylstyrene, p-n-butylstyrene, p-ter-butylstyrene, p-n-hexylstyrene, p-n-octylstyrene, p-n-dodecylstyrene, p-methoxystyrene, p-phenylstyrene, p-chlorostyrene, 3,4-dichlorostyrene and the like.

Examples of (meth)acrylic ester monomers used to constitute the above-specified vinyl copolymer include alkyl esters of acrylic and methacrylic acids, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, stearyl methacrylate and the like.

Particularly suitable are ethyl acrylate, propyl acrylate, butyl acrylate, methyl methacrylate, ethyl methacrylate, propyl methacrylate and butyl methacrylate.

Other useful (meth)acrylic ester monomers include 2-chloroethyl acrylate, phenyl acrylate, α-chloromethyl acrylate, phenyl methacrylate, dimethylaminoethyl methacrylate, 2-hydroxyethyl methacrylate, glycidyl methacrylate, bisglycidyl methacrylate, polyethylene glycol monomethacrylate, methacryloxyethyl phosphate and the like.

The following substances can be used in combination with the above-listed styrene monomer and (meth)acrylic ester monomer: unsaturated carboxylic acids such as acrylic acid, methacrylic acid, fumaric acid, maleic acid, citraconic acid, itaconic acid; and crosslinking monomers such as monoacryloyloxyehtyl succinate, monomethacryloyloxyethyl succinate, acrylonitrile, methacrylonitrile, acrylamide, divinyl benzene, ethylene glycol diacrylate, trimethylolpropane triacrylate, triallyl isocyanurate.

Preferably, the vinyl copolymer contains 60–95% by weight of styrene monomer and 40–5% by weight of (meth) acrylic ester monomer. The lower styrene monomer contents result in the tendency of toners to decrease offset resistance and blocking resistance. On the other hand, the higher styrene monomer contents result in the tendency of toners to decrease their fixability.

The vinyl copolymer can be manufactured by known vinyl polymerization processes such as suspension polymerization, emulsion polymerization, solution polymerization and bulk polymerization. Preferably, a vinyl monomer used to constitute a vinyl copolymer portion (low-molecular weight vinyl copolymer) is solution polymerized in the presence of the remaining copolymer portion (high-molecular weight vinyl copolymer). Alternatively, at least two types of vinyl copolymers (low- and high-molecular weight vinyl copolymers) may be melt mixed or dissolution mixed in a solvent with the following desolvation.

As stated earlier, the present invention utilizes the vinyl copolymer prepared chiefly from a styrene monomer and a (meth)acrylic ester monomer and showing maximum peaks at least in the molecular weight range of 5,000–20,000 and in the molecular weight range of not below 500,000 when its molecular weight distribution is determined by gel permeation chromatography (GPC). The reason is as follows.

The vinyl copolymers having a maximum peak in the molecular weight range of below 5,000 tend to lack strength. The appearance of a maximum peak only in the molecular weight range of above 20,000 results in adversely affecting toner fixability. The appearance of a maximum peak only in the molecular weight range of below 500,000 results in adversely affecting the offset resistance of toners.

In view of storage stability of toners (prevention of toner aggregation), the vinyl copolymer preferably has a glass transition temperature (Tg) of not below 50° C. This glass transition temperature is determined by a differential scanning calorimeter (DSC). In view of toner fixability, the vinyl copolymer preferably has a flow softening point of not exceeding 130° C. The flow softening point is determined by a flow tester.

The toner resin composition of the present invention contains the vinyl copolymer having the above-specified molecular weight distribution, 2–10% by weight of Fischer-Tropsch wax and 0.5–5% by weight of styrenic block copolymer.

The Fischer-Tropsch wax is a synthetic wax comprised principally of straight-chain hydrocarbons and obtainable, for example, by allowing a water gas consisting primarily of carbon monoxide and hydrogen to react at normal pressure at 170–250° C. with the aid of a cobalt, nickel or iron catalyst. For use in the present invention, such a Fischer-Tropsch wax may be manufactured by the so-called Fischer-Tropsch wax process as described above. However, the use of commercial products is more convenient.

The Fischer-Tropsch wax preferably has a weight average molecular weight in the range of 400–2,000, more preferably in the range of 450–850. The use of Fischer-Tropsch wax having a weight average molecular weight of below 400 may reduce storage stability of resulting toners. On the other hand, the use of Fischer-Tropsch wax having a weight average molecular weight of above 2,000 may reduce fixability of resulting toners. This weight average molecular weight is determined by gel permeation chromatography (GPC).

Also, the Fischer-Tropsch wax preferably has a melt viscosity of 5–20 cps at 140° C. The melt viscosity of below 5 cps may result in the reduced storage stability of toners. On the other hand, the melt viscosity of above 20 cps may result in the reduced fixability of toners. Its melt viscosity at 140° C. is determined according to JIS K 6862.

Also, the Fischer-Tropsch wax preferably shows a peak of endotherm accompanying fusion at a temperature of 70–130° C., when measured by a differential scanning calorimeter (DSC). If its peak temperature is below 70° C., the storage stability of a resulting toner may be reduced. This may cause such a toner to block during room temperature storage. On the other hand, if the peak temperature is above 130° C., the Fischer-Tropsch wax may become difficult to melt during fixation, possibly reducing fixability of resulting toners.

Such a Fischer-Tropsch wax is incorporated in the resin composition in the amount of 2–10% by weight. If its content is below 2% by weight, a mold releasing effect may be lowered to reduce the offset resistance of a resulting toner. On the other hand, if the content exceeds 10% by weight, the Fischer-Tropsch wax in a resulting toner may be caused to adhere, in the form of a film, to a photoreceptor.

The styrenic block copolymer, for use in combination with the aforementioned Fischer-Tropsch wax, is obtainable, for example, via living anionic polymerization and may take a diblock, triblock or multiblock structure. Examples of styrenic block copolymers include styrene-butadiene (S-B) block copolymers and their hydrides; styrene-isoprene (S-I) block copolymers and their hydrides; styrene-butadiene-styrene (S-B-S) block copolymers and their hydrides; and styrene-isoprene-styrene (S-I-S) block copolymers and their hydrides.

The styrenic block copolymer preferably contains 20–80% by weight of styrene moieties. If the styrene content falls below 20% by weight, the styrenic block copolymer shows the reduced affinity for the vinyl copolymer, possibly resulting in the reduced dispersibility of the Fischer-Tropsch wax. On the other hand, if the styrene content goes beyond 80% by weight, the styrenic block copolymer shows the reduced affinity for the Fischer-Tropsch wax. Also in this case, the reduced dispersibility of the Fischer-Tropsch wax may result.

The styrenic block copolymer preferably has a number average molecular weight of 1,000–150,000. The styrenic block copolymer, if its number average molecular weight is below 1,000, shows a reduced glass transition temperature, possibly leading to the reduced storage stability of resulting toners. On the other hand, the use of the styrenic block copolymer having a number average molecular weight of above 150,000 may result in adversely affecting the fixability, grindability and productivity of toners.

Such a styrenic block copolymer is incorporated in the toner resin composition in the amount of 0.5–5% by weight. If the styrenic block copolymer content is below 0.5% by weight, the reduced dispersibility of the Fischer-Tropsch wax may result to possibly adversely affect the storage stability of toners. On the other hand, the inclusion of the styrenic block copolymer in the amount of above 5% by weight may result in reducing the fixability, grindability and productivity of toners.

Illustrating one method for manufacturing the toner resin composition of the present invention, a vinyl copolymer having the above-specified molecular weight distribution, predetermined amounts of Fischer-Tropsch wax and styrenic block copolymer, and optional additives known in the toner art, such as a colorant and a charge control agent, are mixed as by a ribbon blender or Henschel mixer, kneaded as by using a roll mill, kneader or extruder, cooled and finally subjected to comminution.

For the purpose of allowing the Fischer-Tropsch wax and styrenic block copolymer to be uniformly mixed in the vinyl copolymer, a procedure may be employed whereby the Fischer-Tropsch wax and styrenic block copolymer are added to a vinyl monomer solution either prior to or in the course of polymerization, or to a polymer solution immediately after polymerization. Alternatively, separately-prepared vinyl copolymer, Fischer-Tropsch wax and styrenic block copolymer may be allowed to dissolve for mixture in a solvent which is subsequently removed.

For ease of manufacture, a method may preferably be employed whereby the Fischer-Tropsch wax and styrenic block copolymer are added to a vinyl monomer solution, for use in the formation of a low-molecular vinyl copolymer, which is subsequently solution polymerized in the presence of a high-molecular vinyl copolymer. As a result, the toner resin composition of the present invention is obtained.

The procedures as practiced heretofore can be utilized to manufacture a toner from the toner resin composition of the present invention. Illustrating one exemplary method, optional additives conventionally known in the toner art, such as a colorant, charge control agent and magnetic powder, are added to the above-described toner resin composition as a binder. The mixture is melt kneaded, ground and then classified.

Examples of colorants useful for incorporation into toners for provision of monochromatic images include carbon black, aniline black, lamp black and the like. Examples of colorants useful for incorporation into toners for provision of color images include C. I. Solvent Red, C. I. Pigment Red, C. I. Disper Red, C. I. Pigment Violet, C. I. Solvent Yellow, C. I. Pigment Yellow, C. I. Disper Yellow, C. I. Solvent Blue, C. I. Pigment Blue and the like. Such a colorant may generally be incorporated in the amount of 1–10% by weight.

The charge control agent is used either for positive charging or negative charging. Examples of charge control agents useful for creation of positively charged toners include nigrosine dyes, quarternary ammonium salts, pyridinium salts and azines. Examples of charge control agents useful for creation of negatively charged toners include SPIRON BLACK (product of Hodogaya Chem. Co., Ltd.), chromium complexes of di-t-butyl salicylic acid, iron complexes and the like. Such a charge control agent may generally be incorporated in the amount of 0.1–10% by weight.

Examples of magnetic powders useful for provision of magnetic toners include ferromagnetic alloys and compounds consisting of iron, zinc, cobalt, nickel or manganese, such as magnetite, ferrite and hematite.

Mold release waxes, such as a low-molecular weight polypropylene wax and a low-molecular weight polyethylene wax, may also be incorporated. In the present invention, the inclusion of Fischer-Tropsch wax results in obtaining a sufficient mold releasing effect, thereby eliminating the need to incorporate other waxes. However, this is not intended to preclude the use of other waxes, such as the above-described low-molecular weight polypropylene wax and low-molecular weight polyethylene wax. Also, a hydrophobic silica or the like may be post-added (externally added).

BEST MODE FOR CARRYING OUT THE INVENTION

The following Examples and Comparative Examples illustrate the present invention.

EXAMPLE 1

Preparation of a Toner Resin Composition 30 parts by weight of a styrene-n-butyl acrylate copolymer (styrene content of 80% by weight, peak maximum molecular weight of 700,000), 4 parts by weight of the Fischer-Tropsch wax (A-1) as specified in Table 1, 1 part by weight of the styrenic block copolymer (B-1) as specified in Table 2, and 100 parts by weight of toluene, were charged into a separable flask where they were allowed to dissolve.

In Table 1, the temperature at which each Fischer-Tropsch wax showed a peak of endotherm accompanying fusion was determined by a differential scanning calorimeter (DSC), Model No. DSC 220 manufactured by Seiko Electronic Ind. Co., Ltd., with a heating rate of 10° C./minute, according to JIS K 7121. The melt viscosity was measured according to JIS K 6862.

After substitution of a gas phase inside the separable flask with nitrogen gas, the flask contents were heated to a boiling point of toluene. A mixed solution containing 50 parts by weight of styrene, 15 parts by weight of n-butyl acrylate and 3.8 parts by weight of benzoyl peroxide (polymerization initiator) was added dropwise to the flask contents while stirred under reflux of toluene over 3 hours to effect solution polymerization.

After the dropwise addition of mixed solution was completed, the flask contents were stirred under reflux of toluene for additional two hours to insure maturation, and then gradually heated to 180° C. The following removal of toluene at a reduced pressure resulted in the provision of a toner resin composition. The molecular weight distribution of this toner resin composition was determined by gel permeation chromatography (GPC) using a GPC instrument. GPC revealed maximum peaks in the 500,000~molecular weight range and in the 8,000~molecular weight range.

For GPC determinations, a Nippon Milipore Limited Model HTR-C was used. For columns, Showa Denko Models KF-800P (one used), KF-806 M (two used) and KF-802.5 (one used) were arranged in series. GPC determinations were made under the following conditions: columns were maintained at 40° C., samples were dissolved in THF to a concentration of 0.2% by weight (and then filtered through a 0.45 μm filter), samples were injected at a volume of 100 μl, and calibration was made using polystyrene standards.

Preparation of a Toner 100 parts by weight of the above-prepared toner resin composition, 6.5 parts by weight of carbon black (MA-100, manufactured by Mitsubishi Chem. Co., Ltd.) and 1.5 parts by weight of chrome-containing dye (S-34, manufactured by Orient Chemical Co., Ltd.) were melt kneaded in a continuous kneader at 150° C., cooled, crushed by a coffee mill, finely ground by a jet mill, and finally classified by a classifier to obtain a toner powder having an average particle size of about 10 μm. 0.3 parts by weight of hyrophobic silica powder (R-972D, manufactured by Nippon Aerosil Co., Ltd.) was mixed (externally added) with 100 parts by weight of the toner powder to prepare a toner.

EXAMPLE 2

20 parts by weight of a styrene-n-butyl acrylate copolymer (styrene content of 70% by weight, peak maximum molecular weight of 2,000,000), 8 parts by weight of the Fischer-Tropsch wax (A-2) as specified in Table 1, 3 parts by weight of the styrenic block copolymer (B-2) as specified in Table 2, and 100 parts by weight of toluene, were charged into a separable flask where they were allowed to dissolve.

After substitution of a gas phase inside the separable flask with nitrogen gas, the flask contents were heated to a boiling point of toluene. A mixed solution containing 60 parts by weight of styrene, 9 parts by weight of n-butyl acrylate and 3.2 parts by weight of benzoyl peroxide (polymerization initiator) was added dropwise to the flask contents while stirred under reflux of toluene over 3 hours to effect solution polymerization.

After dropwise addition of the mixed solution was completed, the flask contents were stirred under reflux of toluene for an additional hour to insure maturation, and then gradually heated to 180° C. The following removal of toluene at a reduced pressure resulted in the provision of a toner resin composition. The molecular weight distribution of this toner resin composition was determined by gel permeation chromatography (GPC). GPC revealed maximum peaks in the 1,500,000~molecular weight range and in the 15,000~molecular weight range.

The procedure of Example 1 was followed, except that the above-obtained toner resin composition was used, to prepare a toner.

EXAMPLE 3

30 parts by weight of a styrene-n-butyl acrylate copolymer (styrene content of 80% by weight, peak maximum molecular weight of 700,000), 3 parts by weight of the styrenic block copolymer (B-2) as specified in Table 2, and 100 parts by weight of toluene, were charged into a separable flask where they were allowed to dissolve.

After substitution of a gas phase inside the separable flask with nitrogen gas, the flask contents were heated to a boiling point of toluene. A mixed solution containing 50 parts by weight of styrene, 9 parts by weight of n-butyl acrylate and 3.8 parts by weight of benzoyl peroxide (polymerization initiator) was added dropwise to the flask contents while stirred under reflux of toluene over 3 hours to effect solution polymerization.

After dropwise addition of the mixed solution was completed, the flask contents were stirred under reflux of toluene for an additional hour to insure maturation, and then gradually heated to 180° C. The subsequent removal of toluene at a reduced pressure resulted in the provision of a toner resin composition which was free of Fischer-Tropsch wax. The molecular weight distribution of this toner resin composition was determined by gel permeation chromatography (GPC) which revealed maximum peaks in the 500,00~molecular weight range and in the 8,000~molecular weight range.

100 parts by weight of the above-obtained Fischer-Tropsch wax-free toner resin composition, 8 parts by weight of the Fischer-Tropsch wax (A-1) specified in Table 1, 6.5 parts by weight of carbon black (MA-100, manufactured by Mitsubishi Chem. Co., Ltd.) and 1.5 parts by weight of chrome-containing dye (S-34, manufactured by Orient Chemical Co., Ltd.) were melt kneaded in a continuous kneader at 150° C., cooled, crushed by a coffee mill, finely ground by a jet mill, and finally classified by a classifier to obtain a toner powder having an average particle size of about 10 μm. 0.3 parts by weight of hyrophobic silica powder (R-972D, manufactured by Nippon Aerosil Co., Ltd.) was mixed (externally added) with 100 parts by weight of the toner powder to prepare a toner.

Comparative Example 1

40 parts by weight of a styrene-n-butyl acrylate copolymer (styrene content of 80% by weight, peak maximum molecular weight of 450,000), 1 part by weight of the Fischer-Tropsch wax (A-3) as specified in Table 1, 0.1 parts by weight of the styrenic block copolymer (B-4) as specified in Table 2, and 100 parts by weight of toluene, were charged into a separable flask where they were allowed to dissolve.

After substitution of a gas phase inside the separable flask with nitrogen gas, the flask contents were heated to a boiling point of toluene. A mixed solution containing 50 parts by weight of styrene, 8.9 parts by weight of n-butyl acrylate and 5.5 parts by weight of benzoyl peroxide (polymerization initiator) was added dropwise to the flask contents while stirred under reflux of toluene over 3 hours to effect solution polymerization.

After dropwise addition of the mixed solution was completed, the flask contents were stirred under reflux of toluene for an additional hour to insure maturation, and then gradually heated to 180° C. The following removal of toluene at a reduced pressure resulted in the provision of a toner resin composition. The molecular weight distribution of this toner resin composition was determined by gel permeation chromatography (GPC). GPC revealed maximum peaks in the 300,000~molecular weight range and in the 4,000~molecular weight range.

The procedure of Example 1 was followed, except that the above-obtained toner resin composition was used, to prepare a toner.

Comparative Example 2

40 parts by weight of a styrene-n-butyl acrylate copolymer (styrene content of 80% by weight, peak maximum molecular weight of 450,000), 15 parts by weight of the Fischer-Tropsch wax (A-4) as specified in Table 1, 8 parts by weight of the styrenic block copolymer (B-3) as specified in Table 2, and 100 parts by weight of toluene, were charged into a separable flask where they were allowed to dissolve.

After substitution of a gas phase inside the separable flask with nitrogen gas, the flask contents were heated to a boiling point of toluene. A mixed solution containing 32 parts by weight of styrene, 5 parts by weight of n-butyl acrylate and 1 part by weight of benzoyl peroxide (polymerization initiator) was added dropwise to the flask contents while stirred under reflux of toluene over 3 hours to effect solution polymerization.

After dropwise addition of the mixed solution was completed, the flask contents were stirred under reflux of toluene for an additional hour to insure maturation, and then gradually heated to 180 ° C. The following removal of toluene at a reduced pressure resulted in the provision of a toner resin composition. The molecular weight distribution of this toner resin composition was determined by gel permeation chromatography (GPC). GPC revealed maximum peaks in the 300,000~molecular weight range and in the 50,000~molecular weight range.

The procedure of Example 1 was followed, except that the above-obtained toner resin composition was used, to prepare a toner.

Comparative Example 3

The procedure of Example 1 was followed, except that 4 parts by weight of the Fischer-Tropsch wax (A-1) specified is in Table 1 was replaced by 4 parts by weight of the Fischer-Tropsch wax (A-4) specified in Table 1, to prepare a toner resin composition.

Also, the procedure of Example 1 was followed, except that the above-obtained toner resin composition was used, to prepare a toner.

Evaluation of Toner Performances 6.5 parts by weight of each of the toners obtained in the preceding Examples and Comparative Examples was mixed with 93.5 parts by weight of iron carrier particles having an average size of 50–80 μm to prepare a developer. By utilizing the prepared developers, the fixation temperature and fixation strength were evaluated according to the below-described procedures. For an electrophotographic copy machine, a Konika Model U-BIX 416AF was rebuilt such that its hot press roll temperature can be varied to a maximum of 210° C.

Also, the toners obtained in the preceding Examples and Comparative Examples were evaluated for storage stability according to the below-described procedure. The performance evaluation results of these toners are shown in Table 3, collectively.

(1) Fixation Temperature Range

A set temperature of hot press rolls incorporated in the above-described electrophotographic copy machine was varied in a stepwise manner to obtain a copied image on a paper at each set temperature. The presence of a toner smudge (offset) on a margin of the paper was observed, and the temperature range where no toner smudge was observed was taken as a fixation temperature range.

(2) Fixation Strength

A set temperature of hot press rolls incorporated in the above-described electrophotographic copy machine was varied between 150° C. and 170° C. to obtain a copied image on a paper at each set temperature. Each copied image was rubbed with a cotton pad. The toner fixation strength was calculated from the following equation:

$$\text{Fixation strength (\%)} = (\text{image density after rubbing}/\text{image density before rubbing}) \times 100$$

The image density was measured by a Macbeth reflection densitometer Model RD-914.

(3) Storage Stability 20 g of each toner was collected in a sample bottle, left to stand in a constant temperature bath at 50° C. for 48 hours, and then subjected to screening by a Hosokawa Micron Powder Tester Model PT-E. Screening was achieved at a vibration of 1 mm for 10 seconds. A fraction of the toner left on a screen having 250 μm openings was weighed. A rating of ○ (passed) was given if the weight did not exceed 1 g and a rating of x (failed) was given if the weight exceeded 1 g.

TABLE 1

| Type of wax | Weight Average Molecular Weight | Melt Viscosity (CPS) at 140° C. | Peak Temperature (° C.) at Endotherm Accompanying Fusion |
|---|---|---|---|
| Fischer-Tropsh Wax (A-1) | 670 | 6 | 98 |
| Fischer-Tropsh Wax (A-2) | 1000 | 10 | 107 |
| Fischer-Tropsh Wax (A-3) | 300 | 3 | 65 |
| Polypropylene Wax (A-4) | 2500 | 1800 | 160 |

TABLE 2

| Styrenic Block Copolymer | Stylene Content (WT. %) | Number Average Molecular Weight |
|---|---|---|
| Hydrogenated S-I-S Triblock Copolymer (B-1) | 65 | 60000 |
| Hydrogenated S-B Diblock Copolymer (B-2) | 30 | 75000 |
| Hydrogenated S-I-S Triblock Copolymer (B-3) | 10 | 300000 |
| Hydrogenated S-B Diblock Copolymer (B-4) | 90 | 500 |

S: Stylene, I: Isoprene, B: Butadiene

TABLE 3

| | Fixation Temperature Range (° C.) | Fixation Temperature Variation (° C.) | Fixation Strength (%) 150° C. | Fixation Strength (%) 170° C. | Storage Stability |
|---|---|---|---|---|---|
| Ex. 1 | 140–210 ↑ | 70 ↑ | 75 | 88 | ○ |
| Ex. 2 | 140–210 ↑ | 70 ↑ | 76 | 88 | ○ |
| Ex. 3 | 140–210 ↑ | 70 ↑ | 75 | 90 | ○ |
| Comp. Ex. 1 | 140–180 | 40 | 70 | 77 | x |
| Comp. Ex. 2 | 155–210 | 55 | — | 70 | x |
| Comp. Ex. 3 | 150–210 ↑ | 60 ↑ | 60 | 68 | ○ |

UTILITY IN INDUSTRY

As stated earlier, the toner resin composition of the present invention contains a vinyl copolymer prepared principally from a styrene monomer and a (meth)acrylic ester monomer, 2–10% by weight of Fischer-Tropsch wax and 0.5–5% by weight of styrenic block copolymer. The vinyl copolymer, when its molecular weight distribution is determined by gel permeation chromatography, shows maximum peaks at least in the molecular weight range of 5,000–20,000 and in the molecular weight range of not below 500,000. The use of such a toner resin composition results in the provision of the toner of the present invention which has excellent levels of low-temperature fixability, offset resistance, storage stability and fixing strength to a sheet as of a paper. The present invention provides a notable effect, i.e., copying with the use of the present toner by a high-speed or compact electrophotographic copy machine results in providing sustained clear and stable images.

In particular, the present invention uses the Fischer-Tropsch wax in the place of conventional low-molecular weight waxes, such as low-molecular weight polypropylene. The presence of the styrenic block copolymer helps disperse the Fischer-Tropsch wax and allows its uniform dispersion. The amount of the Fischer-Tropsch wax required to impart mold releasability is smaller compared to those required for conventional low-molecular weight waxes such as low-molecular weight polypropylene. This advantageously results in obtaining sufficient offset resistance and stable images without adversely affecting the quantity of charge.

What is claimed is:

1. A toner resin composition comprising:

a vinyl copolymer prepared principally from a styrene monomer and a (meth)acrylic ester monomer and showing maximum peaks at least in the molecular weight range of 5,000–20,000 and in the molecular weight of not below 500,000 when its molecular weight distribution is determined by gel permeation chromatography;

2–10% by weight of Fischer-Tropsch wax which has a weight average molecular weight of 400–2,000 and a melt viscosity of 5–20 cps at 140° C., and shows a peak of endotherm accompanying fusion at a temperature of 70–130° C. when measured by a differential scanning calorimeter; and 0.5–5% by weight of styrenic block copolymer.

2. The toner resin composition as recited in claim 1, characterized in that said styrenic block copolymer contains 20–80% by weight of styrene moieties and has a number average molecular weight of 1,000–150,000.

3. A toner comprising:

a toner resin composition comprising a vinyl copolymer prepared principally from a styrene monomer and a (meth)acrylic ester monomer and showing maximum peaks at least in the molecular weight range of 5,000–20,000 and in the molecular weight range of not below 500,000 when its molecular weight distribution is determined by gel permeation chromatography, 2–10% by weight of Fischer-Tropsch wax which has a weight average molecular weight of 400–2,000 and a melt viscosity of 5–20 cps at 140° C. and shows a peak of endotherm accompanying fusion at a temperature of 70–130° C. when measured by a differential scanning calorimeter;

0.5–5% by weight of styrenic block copolymer; and a colorant.

4. The toner as recited in claim 3, characterized in that said styrenic block copolymer contains 20–80% by weight of styrene moieties and has a number average molecular weight of 1,000–150,000.

* * * * *